US009080465B2

(12) United States Patent
Effert et al.

(10) Patent No.: US 9,080,465 B2
(45) Date of Patent: Jul. 14, 2015

(54) METHOD FOR CONTROLLING A SHORT-TERM INCREASE IN POWER OF A STEAM TURBINE

(75) Inventors: Martin Effert, Erlangen (DE); Frank Thomas, Erlangen (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 236 days.

(21) Appl. No.: 13/877,743

(22) PCT Filed: Oct. 4, 2011

(86) PCT No.: PCT/EP2011/067294

§ 371 (c)(1),
(2), (4) Date: Apr. 4, 2013

(87) PCT Pub. No.: WO2012/045730

PCT Pub. Date: Apr. 12, 2012

(65) Prior Publication Data

US 2013/0186091 A1 Jul. 25, 2013

(30) Foreign Application Priority Data

Oct. 5, 2010 (DE) ..... 10 2010 041 964

(51) Int. Cl.
*F01K 13/02* (2006.01)
*F22G 5/12* (2006.01)
(Continued)

(52) U.S. Cl.
CPC ..... *F01K 7/165* (2013.01); *F01K 11/02* (2013.01); *F01K 13/02* (2013.01); *F22B 1/18* (2013.01); *F22G 5/12* (2013.01)

(58) Field of Classification Search
CPC ..... F22B 35/101; F22B 35/104; F22B 29/10; F22B 35/10; F22B 1/18; F22G 5/12; F22G 5/14; F22G 5/20; F01K 7/165; F01K 11/02; F01K 13/02
USPC ..... 60/646, 657, 664, 667; 122/479.1, 122/479.7, 406.4, 487; 236/14
See application file for complete search history.

(56) References Cited

U.S. PATENT DOCUMENTS 3,189,008 A * 6/1965 Schroedter et al. ..... 122/451.1
3,260,246 A * 7/1966 Zwetz ..... 122/451 S
(Continued)

FOREIGN PATENT DOCUMENTS

CN 1143947 C 3/2004
CN 103097671 A 5/2013
(Continued)

*Primary Examiner* — Hoang Nguyen

(57) ABSTRACT

A method is provided for controlling a short-term increase in power in a steam turbine including a fossil-fired steam generator having a flow path through which a flow medium flows. The method involves tapping off the flow medium from the flow path in a pressure stage and injecting it into the flow path on the flow-medium side upstream of a super heater heating surface of the respective pressure stage. A first characteristic value is used as a controlled variable for the amount of injected flow medium. The first characteristic value is characteristic of the deviation between the outlet temperature of a final super heater heating surface of the respective pressure stage on the flow medium side and a predetermined nominal temperature value. The nominal temperature value is reduced and, for the duration of the reduction in the nominal temperature value, the characteristic value is temporarily increased over-proportionately to the deviation.

5 Claims, 3 Drawing Sheets

(51) Int. Cl.

| | |
|---|---|
| ***F01K 7/16*** | (2006.01) |
| ***F22B 1/18*** | (2006.01) |
| ***F01K 11/02*** | (2006.01) |

(56) References Cited

U.S. PATENT DOCUMENTS

| | | | | | |
|---|---|---|---|---|---|
| 3,306,044 | A | * | 2/1967 | Zwetz et al. | 60/662 |
| 3,850,148 | A | | 11/1974 | Laubli | |
| 3,942,483 | A | * | 3/1976 | Laubli | 122/448.1 |
| 4,028,884 | A | * | 6/1977 | Martz et al. | 60/39.182 |
| 4,031,863 | A | * | 6/1977 | Laubli | 122/479.1 |
| 4,144,846 | A | | 3/1979 | Miszak | |
| 4,241,701 | A | | 12/1980 | Morse | |
| 6,301,895 | B1 | | 10/2001 | Kallina et al. | |
| 6,474,069 | B1 | | 11/2002 | Smith | |
| 2011/0139094 | A1 | * | 6/2011 | Bruckner et al. | 122/451.1 |

FOREIGN PATENT DOCUMENTS

| | | | |
|---|---|---|---|
| DE | 19750125 | A1 | 3/1999 |
| DE | 19749452 | A1 | 5/1999 |
| DE | 19901656 | A1 | 7/2000 |
| EP | 2224164 | A1 | 9/2010 |
| FR | 2401380 | A1 | 3/1979 |
| JP | S4962802 | A | 6/1974 |
| JP | H0252904 | A | 2/1990 |
| JP | H0388904 | A | 4/1991 |
| JP | H08135908 | A | 5/1996 |
| JP | 2013537271 | A | 9/2013 |

* cited by examiner

METHOD FOR CONTROLLING A SHORT-TERM INCREASE IN POWER OF A STEAM TURBINE

CROSS REFERENCE TO RELATED APPLICATIONS

This application is the US National Stage of International Application No. 10 2010 041 964.8, filed Oct. 4, 2011 and claims the benefit thereof. The International Application claims the benefits of German application No. 02020602.5 DE filed Oct. 5, 2010. All of the applications are incorporated by reference herein in their entirety.

FIELD OF INVENTION

The invention relates to a method for controlling a short-term increase in power of a steam turbine with an upstream fossil-fired steam generator having a number of economizer, evaporator and super heater heating surfaces, which form a flow path and through which a flow medium flows, wherein flow medium is tapped off from the flow path in a pressure stage and is injected into the flow path on the flow-medium side upstream of a super heater heating surface of the respective pressure stage, a first characteristic value, which is characteristic of the deviation between the outlet temperature of the final super heater heating surface of the respective pressure stage on the flow medium side and a predetermined nominal temperature value being used as a control variable for the amount of injected flow medium.

BACKGROUND OF INVENTION

A fossil-fired steam generator generates superheated steam with the aid of the heat generated as the result of the combustion of fossil fuels. Fossil-fired steam generators are mainly used in steam power plants, which predominantly serve the purpose of generating electricity, the steam generated being supplied to a steam turbine.

Along similar lines to the various pressure stages in a steam turbine, fossil-fired steam generators likewise encompass a plurality of pressure stages with different thermal states of the respective water-steam mixture contained therein. In the first (high) pressure stage, the flow medium runs on its flow path first through the economizers, which use residual heat to pre-heat the flow medium, and subsequently through various stages of evaporator and super heater heating surfaces. The flow medium is evaporated in the evaporator, and then any residual moisture is separated off in a separating device and the remaining steam is further heated in the super heater. Then the superheated steam flows into the high pressure section of the steam turbine, is released there and supplied to the subsequent pressure stage of the steam generator, where it is superheated again (intermediate super heater) and supplied to the next pressure section of the steam turbine.

Due to various external influences, the heat output transmitted to the super heaters may vary considerably. Therefore, it is frequently necessary to regulate the superheating temperature. This is usually achieved mostly by an injection of feedwater upstream or downstream of individual super heater heating surfaces to cool them, that is, an overflow line branches off from the main flow of the flow medium and leads to injection valves that are disposed there accordingly. In such cases, the injection is usually controlled by means of a characteristic value characteristic of the temperature deviations from a predetermined nominal temperature value at the super heater outlet.

Modern power plants are expected not only to achieve high degrees of efficiency, but also a mode of operation that is as flexible as possible. In addition to short start-up times and fast load change rates, this also involves the possibility to compensate for frequency disturbances in the electricity grid. To meet these expectations, the power plant must be in the position to provide additional power of, for example, 5% and more within a few seconds.

Such changes in the power provided by a power plant unit in a time frame of seconds are only possible with the aid of a co-ordinated interaction of the steam generator and the steam turbine. The contribution that the fossil-fired steam generator can make thereto is the use of its storage accumulators, that is, of the steam accumulator but also of the fuel accumulator, in addition to rapid changes in the controlling variables of feedwater, injection water, fuel and air.

This can ensue, for example, by the opening of partly throttled turbine valves of the steam turbine or of what is known as a step valve, by means of which the steam pressure is lowered upstream of the steam turbine. As a result, steam is released from the steam accumulator of the upstream fossil-fired steam generator and is supplied to the steam turbine. This measure allows an increase in power to be achieved within a few seconds.

A permanent throttling of the turbine valves to maintain a reserve always leads, however, to a loss in the degree of effectiveness such that for an economic mode of operation the degree of throttling should be kept as low as is absolutely necessary. Moreover, some designs of fossil-fired steam generators, such as, for example, forced-flow steam generators, sometimes have a considerably lower storage volume than, for example, natural circulation steam generators. In the method described in the aforementioned, the difference in the size of the accumulator affects the performance when there are changes in the power of the power plant block.

SUMMARY OF INVENTION

The invention therefore addresses the problem of providing a method for controlling a short-term increase in power of a steam turbine comprising an upstream fossil-fired steam generator of the aforementioned type, in which method there is not an excessive adverse effect on the degree of effectiveness of the steam process overall. At the same time, the short-term increase in power is intended to be facilitated independently of the design of the fossil-fired steam generator without invasive physical modifications to the system overall.

The object is achieved according to the invention by the nominal temperature value being reduced and, for the duration of the reduction in the nominal temperature value, the characteristic value being temporarily increased over-proportionately to the deviation, in order to achieve a short-term increase in power of the steam turbine.

The invention is based on the consideration that additional injection of feedwater can make a further contribution to the short-term rapid change in power.

As result of said additional injection in the region of the super heaters, the steam mass flow can in fact be temporarily increased. However, if an injection is triggered such that it by-passes the steam temperature control system that usually regulates it, in this case it is not always possible to avoid an impermissibly high drop in the steam temperature upstream of the turbine. Furthermore, in the re-activation of the entire steam temperature control that is subsequently required, varying degrees of disturbances in the operation of the steam temperature control must be expected. For these reasons, it is therefore more advantageous to use the steam temperature control that is active when operating under load also to provide the short-term power reserve. The injection should therefore be triggered by the nominal temperature value being reduced. A jump in the nominal temperature value is linked via a corresponding characteristic value with a jump in the control deviation, which deviation then causes the controller to change the degree of opening of the injection control valve. Consequently an increase in the power of the steam turbine can be achieved, precisely as a result of such a measure, that is, an abrupt reduction in the nominal temperature value can be achieved.

This increase in power and consequently the injected mass flow are supposed to be provided as quickly as possible, however. Yet damping properties of the control system, which prevent excessively rapid changes in the injected mass flow, something which is even desirable in the usual operation under load for reasons of the stability of the control but not when a increase in power has to be provided quickly, can be an obstacle here. The control should therefore be adapted accordingly for cases involving a short-term increase in power. This is possible in a particularly simple manner by amplifying the control signal for the injected mass flow accordingly, and in fact for the duration of the desired short-term increase in power. For this purpose, the characteristic value characteristic of the deviation of the outlet temperature of the final super heater heating surface on the flow medium side from a predetermined nominal temperature value is temporarily increased over-proportionately to the deviation for the duration of the reduction in the nominal temperature value.

In the method described above, a nominal/actual comparison is carried out in a corresponding control system via a subtractor circuit between the desired and measured steam temperature. According to the controlling concept used, this signal can be further modified using additional information from the process, before it is subsequently transmitted as an input signal (control deviation) to a PI regulator, for example.

Advantageously, the temperature immediately downstream from the point of injection of the flow medium, that is, at the inlet for the final super heater heating surfaces, can be used as a control variable. In such a "twin circuit control", abrupt changes in the injected mass flow that have occurred due to a regulator intervention are dampened. Under these circumstances the control, which is optimized for rapid intervention, can be stabilized by preventing overshoot.

However, this damping effect exerted by the twin circuit control is more of an obstacle with respect to the provision of an immediate reserve via the injection system. It is therefore especially advantageous with twin circuit regulation in particular to carry out the aforementioned amplifying adjustment of the characteristic value. The artificial increase in the deviation of the actual temperature from the pre-established nominal value that is thus generated at the control end achieves the result that the subsequent correction by means of the temperature at the entrance to the final super heater heating surfaces, that is, immediately downstream of the place of injection, turns out to be relatively lower in the case of twin circuit control. As a result thereof, a greater control deviation persists, the direct consequence of which is a greater controller response, that is, a greater increase in the injected mass flow, which in this case is desirable. Due to the fact that the characteristic value is temporarily increased over-proportionately to the deviation only for the duration of the reduction in the nominal temperature value, however, the influence of said excessive increase disappears again, such that the steam temperature that has been set above the nominal value can also really be achieved. Thus the advantage of twin circuit control whereby unauthorized drops in steam temperature are avoided is still maintained.

The temporary increase in the characteristic value can be achieved in a particularly simple manner by the characteristic value characteristic of the deviation of the temperature from the nominal value being advantageously formed from the sum of said deviation and a second characteristic value that is characteristic of the change over time in the nominal temperature value. Here, in a particularly advantageous embodiment, the second characteristic value is essentially the change over time in the nominal temperature value multiplied by an amplification factor. In terms of control technology this is achieved by the predetermined nominal steam temperature value being used as the input signal for a differentiating element of the first order and the outcome of this element being subtracted, after appropriate amplification, from the difference between the measured and the predetermined temperature at the outlet of the heating surfaces. As a result thereof, the desired artificial increase in the deviation is achieved in a particularly simple manner and by means of the additional differentiating element of the first order, the injected mass flow and hence the additional power released, is increased at a considerably faster rate via the steam turbine.

Due to the differential character, that is, to the fact that only the change over time in the nominal value is taken into consideration, the influence of such a control on the system as a whole decreases as time progresses (what is known as a vanishing impulse). This means that the differentiating element does not have any further influence on the control deviation and the actual temperature that has been set via the nominal value is also achieved. Even in the event that the nominal steam temperature value does not change (which is the normal case in normal load operation) such a configuration does not influence the remaining control structure. Consequently, in normal operation under load, there are no differences in the control properties of the steam temperature control between the control structure with or without said additional differentiating element.

In an advantageous embodiment, a parameter for one of the characteristic values is determined in a plant-specific manner This means that the level of amplification, the parameters of the differentiating element, and so forth should be determined specifically on the basis of the plant involved in the individual case. This can be done in advance, for example, with the aid of simulation equations or, however, during the start-up of the control.

In an advantageous embodiment a control system for a fossil-fired steam generator having a number of economizer, evaporator and super heater heating surfaces, which form a flow path and through which a flow medium flows, includes means for carrying out the method. In a further advantageous embodiment, a fossil-fired steam generator for a steam power plant includes such a control system and also a steam power plant includes such a fossil-fired steam generator.

The advantages achieved by the invention consist in particular in the fact that as a result of the targeted reduction in the nominal steam temperature value, using the injection controlling method, the thermal energy stored in the metallic masses located downstream of injection can be used for a temporary increase in the power of the steam turbine. If the adjusted control methods that have been described are used to do this, in the event of an abrupt reduction in the nominal steam temperature value, considerably faster increases in power can be achieved with the aid of the injection system. The method can be used in every pressure stage, either individually or in combination, that is, both with fresh steam (high pressure stage) and with intermediate superheating steam (medium or low pressure stage).

As a result of the integration into the existing steam temperature control system, after the injection fittings have opened there is no noticeable drop below the reduced nominal temperature value where there is a good control quality of the temperature control. Consequently, an impermissibly high drop in the temperature of the steam at the turbine inlet is effectively counteracted. Processes of switching the control and the co-ordination unit on and off are likewise no longer necessary since the control system can remain active permanently.

Furthermore, the method for the provision of a temporary increase in the power of the steam turbine is independent of other measures, such that throttled turbine valves, for example, can also be additionally opened in order to further amplify the increase in the power of the steam turbine. The effectiveness of the method remains largely unaffected by these parallel measures.

It needs to be emphasized in this context that, where there is a firmly specified demand for additional power, the degree of throttling of the turbine valves can be reduced should the use of the injection system come to be applied to increase the power. Under these circumstances, the desired release of power can then also be achieved with less, and in the most favorable case even completely without any, additional throttling. The plant can consequently be operated in normal load operation, in which it has to be available for an immediate reserve, with a comparatively higher degree of effectiveness, which also reduces the operating costs.

Finally, the method can also be carried out without invasive design measures but merely by additional components being provided or implemented in the control system. As a result, greater plant flexibility and benefits are achieved without additional costs.

BRIEF DESCRIPTION OF THE DRAWINGS

An exemplary embodiment of the invention is described in more detail with reference to a drawing. The figures represent.

DETAILED DESCRIPTION OF INVENTION

Identical components are denoted by the same reference signs in all the figures.

Figure 1:
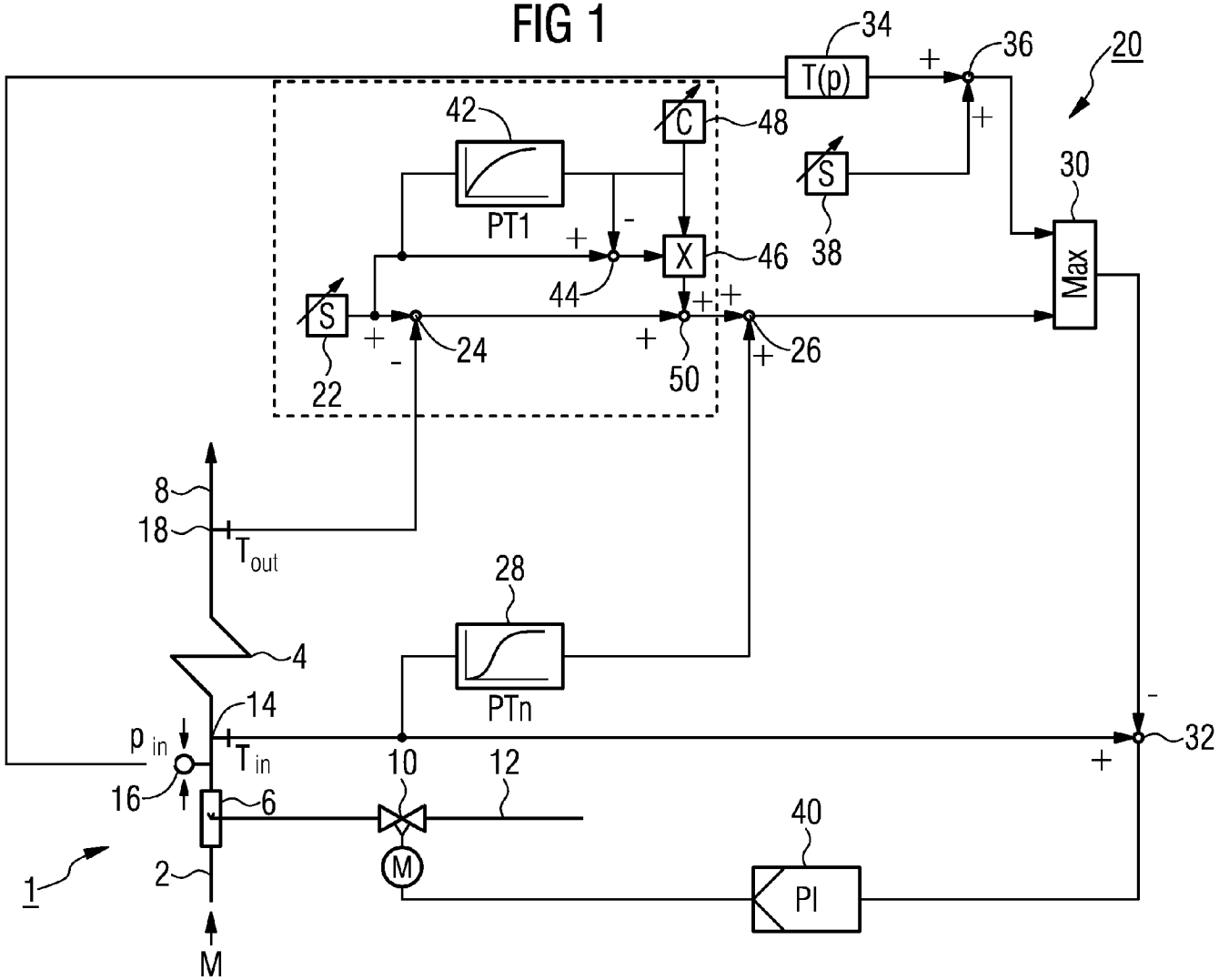
FIG. 1 on the flow medium side, in diagram form, the medium pressure section of a fossil-fired steam generator with the circuitry at the data end of the injection control system with twin circuit control to be used for an immediate release of power FIG. 2 a diagram comprising simulation results for improving the immediate reserve of a fossil-fired steam generator by increasing the injection of high pressure steam, intermediate superheating steam and in each case in both pressure systems in an upper load range, and FIG. 3 a diagram comprising simulation results for improving the immediate reserve of a fossil-fired steam generator by increasing the injection of high pressure steam, intermediate superheating steam and in each case in both pressure systems for a lower load range.

The medium pressure section of the fossil-fired steam generator 1 is shown by way of example in FIG. 1. The invention can of course also be used in other pressure stages. FIG. 1 shows a diagram of part of the flow path 2 of the flow medium M, in particular the super heater heating surfaces 4. The spatial arrangement of the individual super heater heating surfaces 4 in the hot gas duct is not shown and may vary. The super heater heating surfaces 4 that are shown can each represent a plurality of heating surfaces connected in series, which for the sake of clarity are not differentiated from one another, however.

The flow medium M is released in the high pressure section of a steam turbine before it enters the section shown in FIG. 1. The flow medium M can then optionally enter a first super heater heating surface that is not shown before it reaches the section that is shown. Initially, an injection valve 6 is arranged on the flow medium side. Here cooler and unevaporated flow medium M can be injected to control the outlet temperature at the outlet 8 of the medium pressure section of the fossil-fired steam generator 1. The amount of flow medium M that is introduced into the injection valve 6 is regulated via an injection control valve 10, the flow medium M being supplied via an overflow line 12 that previously branches off in the flow path 2. In the flow path 2 a plurality of measuring devices are further provided to regulate injection, that is, a temperature measuring device 14 and a pressure measuring device 16 downstream of the injection valve 6 and upstream of the super heater heating surfaces 4, and also a temperature measuring device 18 downstream from the super heater heating surfaces 4.

The remaining parts of FIG. 1 show the control system 20 for injection. First a nominal temperature value is set on a set-point generator 22. Said nominal temperature value is transmitted together with the outcome of the temperature measuring device 18 downstream of the super heater heating surfaces 4 to a subtractor element 24, where the deviation of the temperature at the outlet of the super heater heating surfaces 4 from the nominal value is consequently created. Said deviation is corrected in a summer element 26, with the correction modeling the time lag for a temperature change in the flow path through the super heater heating surfaces 4. For this purpose, the temperature at the inlet to the super heater heating surfaces 4 is transmitted out of the temperature measuring device 14 to a time-delaying PTn element 28 that is supplied to the summer element 26. The outcome from the summer element 26 is connected to a maximal element 30 and subsequently to a subtractor element 32, together with the signal from the temperature measuring device 14.

In the maximal element 30, a further parameter is taken into consideration at the input end, that is, the fact that the temperature should be a certain distance removed from the pressure-dependent boiling temperature. For this purpose, the pressure measured in the pressure measuring device 16 is transmitted to a function element 34 that displays the boiling temperature of the flow medium M corresponding to this pressure. In a summer element 36, a preset constant which can be 30° C., for example, and which guarantees a safe distance from the boiling curve, is added from a generator 38. The minimum temperature thus determined is transmitted to the maximal element 30. The signal detected in the maximal element 30 is transmitted via the subtractor element 32 to a PI control element 40 to control the injection control valve 10.

In order to be able to use the injection system not only to regulate the outlet temperature but also to be able provide an immediate power reserve, said injection system includes appropriate means for carrying out the method for controlling a short-term increase in power in a steam turbine. For this purpose, the nominal temperature value on the set-point generator 22 is first reduced, which leads to an increase in the amount injected. So that this increase immediately leads to an increase in power, a rapid controller response from the PI control element 40 should be guaranteed. The deviation between the actual temperature and the nominal temperature value that has been created is reduced by the PTn element, however, shortly after the change has been made.

In order to prevent this in a case where a rapid increase in power is desired, the signal from the set-point generator 22 for the nominal temperature value is transmitted to a differentiating element of the first order (a DT1 element). For this purpose a PT1 element 42 is acted upon at the input end by the signal from the set-point generator 22 and at the output end is transmitted together with the original signal from the set-point generator 22 to a subtractor element 44, the outcome of which is combined with a multiplier element 46 that amplifies the signal by a factor of 10, for example, from a generator 48. This signal is again supplied from the subtractor element 24 via the summer element 50 to the signal for the temperature deviation. In the event of a change in the nominal value, via the PT1 element 42 the circuitry generates a signal that is different from zero, which is amplified via the multiplier element 46 and artificially amplifies the characteristic value characteristic of the deviation over-proportionally. The signal via the circuitry of the PTn element 28 is then relatively lower and a faster controller response from the PI control element 40 is imposed. Thus an increase in the amount of steam is achieved and the power of the steam turbine that is arranged downstream is increased.

Figure 2:
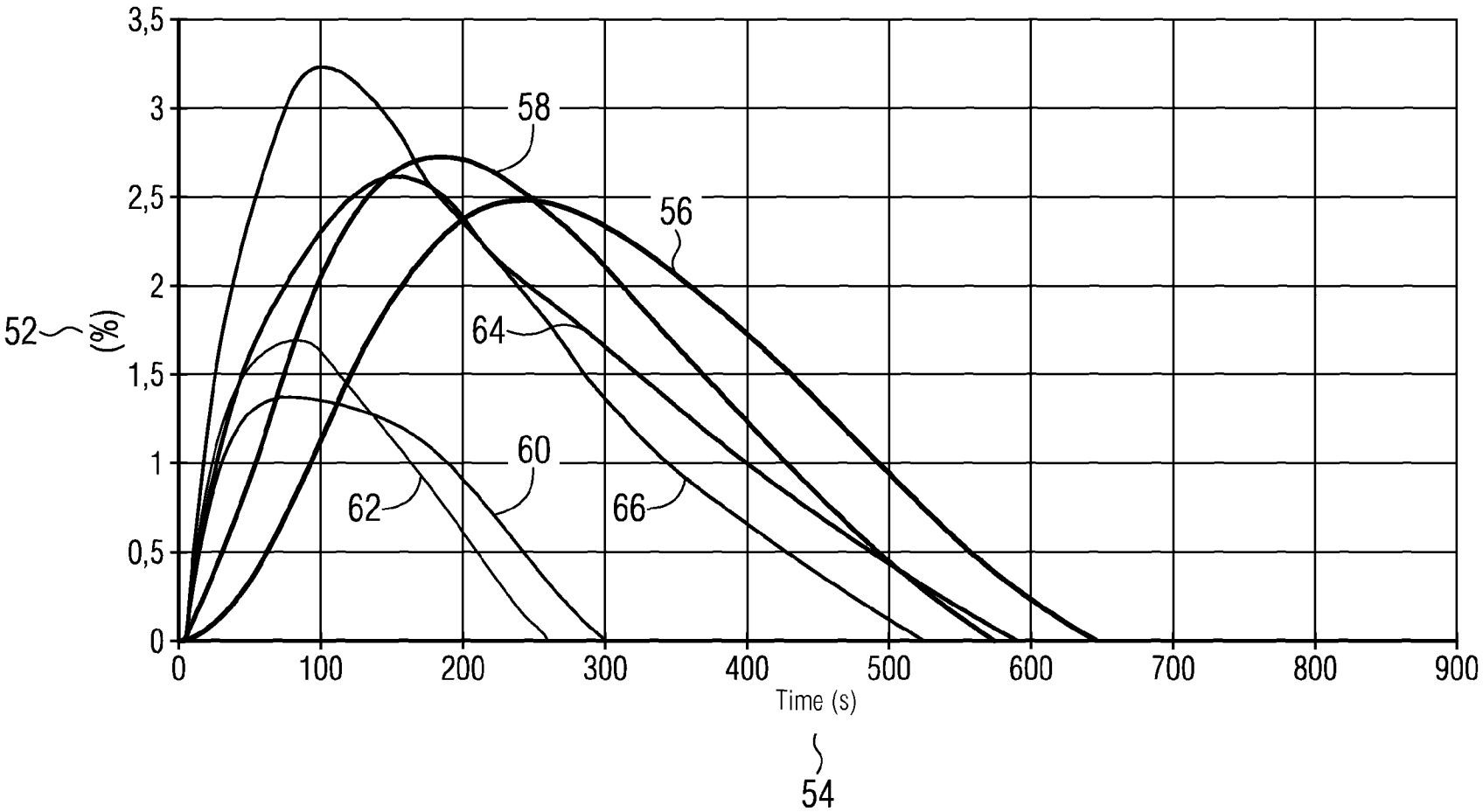

FIG. 2 for its part shows a diagram comprising the simulation results utilizing the control method described. It represents the percentage of additional power as a function of full load 52, against the time 54 in seconds after an abrupt reduction in the nominal temperature value in the set-point generator 22 by 20° C. for each stage in a fossil-fired steam generator comprising a high pressure stage and an intermediate superheating or medium pressure stage at 95% load. As already mentioned, the aforementioned circuitry comprising the PT1 element 42 can be used in both stages for over-proportional amplification of the characteristic value characteristic of the deviation. Curves 56 and 58 show the results for a modification of the high pressure section, curves 60 and 62 show the results for a modification of the intermediate superheating, and curves 64 and 66 show the results for a modification of both stages. Here curves 56, 60 and 64 each show the results without the PT1 element 42, that is, according to the usual control system, and curves 58, 62 and 66 each show the results using the aforementioned interconnected PT1 element 42.

It can be seen from FIG. 2 that the peaks of the curves 58, 62 and 66 are each both higher and further to the left than their respective corresponding curves 56, 60 and 64. The additional power released is therefore both greater and available faster. The acceleration is less marked in curves 60, 62 for intermediate superheating, but a significant relative increase in power can be seen, albeit in an absolutely lower level than in the high pressure section.

Figure 3:
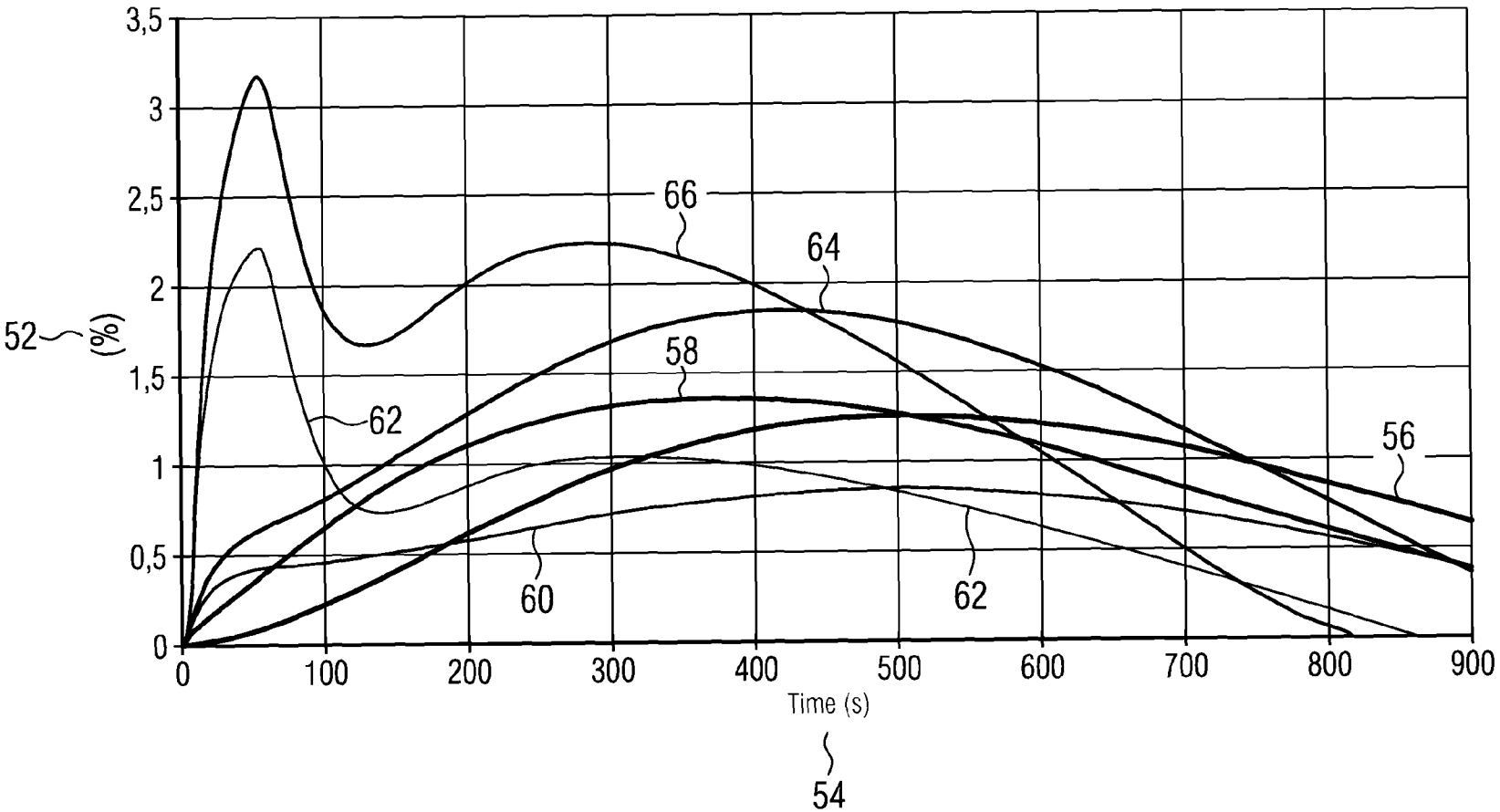

FIG. 3 has only been slightly modified from FIG. 2 and shows the simulated curves 56, 58, 60, 62, 64, 66 for 40% load; all other parameters concur with FIG. 2, as does the significance of the curves 56, 58, 60, 62, 64, 66.

Here in particular the unmodified curves 56, 60, 62 show a considerably flatter line than in FIG. 2, that is, an even slower controller response of the PI control element 40 can be seen. As a result of the aforementioned circuitry of the PT1 element 42 in the high pressure section, the peak of curve 58 is further to the left and higher than curve 56 and therefore a faster and greater increase in power has been achieved. Curve 58 remains relatively flat, however.

The modification of the intermediate superheating, represented in curve 62, shows a similar pattern; in addition, however, a comparatively high increase in power appears about 60 seconds after the change in the nominal value, which then quickly drops again and merges into the peak on the flat curve line. This increase in power appears accordingly even when there is a modification of both pressure stages according to curve 66 as against curve 64.

A steam power plant equipped with such a fossil-fired steam generator 1 is in the position to rapidly achieve an increase in the power of the steam turbine via an immediate release of power from the steam turbine, which increase serves the function of supporting the frequency of the electrical grid system. Due to this power reserve being achieved by a double use of the injection fittings alongside the usual temperature control, a permanent throttling of the steam turbine valves to provide a reserve can also be reduced or completely eliminated, as a result of which a particularly high degree of effectiveness during normal operation can be achieved.

The invention claimed is:

1. A method for controlling a short-term increase in power in a steam turbine comprising a fossil-fired steam generator arranged upstream having a plurality of economizer, evaporator and super heater heating surfaces, which form a flow path and through which a flow medium flows, the method comprising:

tapping off the flow medium from the flow path in a pressure stage and injecting it into the flow path on the flow-medium side upstream of a super heater heating surface of the respective pressure stage, wherein a first characteristic value is used as a controlled variable for the amount of injected flow medium, the first characteristic value being characteristic of the deviation between the outlet temperature of the final super heater heating surface of the respective pressure stage on the flow medium side and a predetermined nominal temperature value, wherein, in order to achieve a short-term increase in power of the steam turbine, the nominal temperature value is reduced and, for the duration of the reduction in the nominal temperature value, the characteristic value is temporarily increased over-proportionately to the deviation.

2. The method as claimed in claim 1, wherein, in addition, the temperature directly downstream from the point of injection of the flow medium is used as a controlled variable for the amount of injected flow medium.

3. The method as claimed in claim 1, wherein the first characteristic value is made up of the sum of the deviation and a second characteristic value that is characteristic of the change over time in the nominal temperature value.

4. The method as claimed in claim 3, wherein the second characteristic value is essentially the change over time in the nominal temperature value multiplied by an amplification factor.

5. The method as claimed in claim 1, wherein a parameter for one of the characteristic values is determined in a plant-specific manner.

* * * * *